US009334081B2

(12) United States Patent
Derby et al.

(10) Patent No.: US 9,334,081 B2
(45) Date of Patent: May 10, 2016

(54) FOLDING SIDE-WALL CONTAINER AND AUTOMATED SYSTEM OF USE

(71) Applicants: Stephen Derby, Troy, NY (US); Gene Eckert, Hamburg, NJ (US); David Brown, Pittsford, NY (US); John McFadden, Brattleboro, VT (US)

(72) Inventors: Stephen Derby, Troy, NY (US); Gene Eckert, Hamburg, NJ (US); David Brown, Pittsford, NY (US); John McFadden, Brattleboro, VT (US)

( * ) Notice: Subject to any disclaimer, the term of this patent is extended or adjusted under 35 U.S.C. 154(b) by 563 days.

(21) Appl. No.: 13/773,740

(22) Filed: Feb. 22, 2013

(65) Prior Publication Data

US 2014/0054361 A1 Feb. 27, 2014

Related U.S. Application Data

(60) Provisional application No. 61/634,008, filed on Feb. 22, 2012, provisional application No. 61/634,010, filed on Feb. 22, 2012.

(51) Int. Cl.

*B65D 5/72* (2006.01)
*B65D 25/00* (2006.01)
*B65D 5/20* (2006.01)

(52) U.S. Cl.

CPC ..... *B65D 5/72* (2013.01); *B65D 5/2052* (2013.01); *B65D 25/005* (2013.01)

(58) Field of Classification Search

CPC ..... B65D 5/72; B65B 5/00; B65B 5/08; B65B 5/10; B65B 5/105; B65B 5/106; B65B 5/108

USPC ..... 53/155, 531, 258, 202, 235

See application file for complete search history.

(56) References Cited

U.S. PATENT DOCUMENTS 3,753,509 A * 8/1973 Kock ..... B65B 21/18 198/404
4,329,831 A * 5/1982 Warkentin ..... B65B 25/046 53/240
4,517,791 A * 5/1985 Focke ..... B65B 35/58 198/374
4,781,011 A * 11/1988 Prakken ..... B65B 5/101 53/202
4,901,504 A * 2/1990 Tsuji ..... B65B 21/18 53/247
5,321,929 A * 6/1994 Hanevold ..... B65B 21/10 53/246
5,515,664 A * 5/1996 Tanaka ..... B65B 5/06 53/243
6,241,449 B1 * 6/2001 Krooss ..... B65B 69/00 414/419
6,959,525 B2 * 11/2005 Prakken ..... B65B 5/061 53/249
7,219,485 B2 * 5/2007 Battisti ..... B65B 21/18 198/418.5
8,316,624 B2 * 11/2012 Prakken ..... B65B 5/061 53/447
8,689,530 B2 * 4/2014 Prahm ..... B65B 5/061 53/247
8,997,438 B1 * 4/2015 Fallas ..... B65G 47/914 414/222.01
2009/0249750 A1 * 10/2009 Black ..... B65B 5/061 53/443
2011/0167771 A1 * 7/2011 Till ..... B65B 5/061 53/475
2015/0013277 A1 * 1/2015 Brandhorst ..... B65B 35/18 53/475

* cited by examiner

*Primary Examiner* — Gloria R Weeks

(74) *Attorney, Agent, or Firm* — Malcolm J. Chisholm, Jr.

(57) ABSTRACT

The folding side-wall container (10, 62, 66) provides for efficient loading and unloading of the containers appropriate for retail re-supply of goods (52, 64, 90). Use of the containers as a distribution container (62) and a wholesale goods container (66) within an automated system (60) for automated transfer by a robotic picker (68) of goods (64) from the wholesale container (66) to the distribution container (62) minimizes labor costs in distribution of the goods (64). The container (10) includes a folding wall (22) that is releasably secured in a closed position by a top lid (34) having an engagement lip (42) that secures a top edge (46) of the folding side or front wall (22). Opening the top lid (34) and then folding down the front wall (22) permits efficient loading and unloading of the container (10).

6 Claims, 10 Drawing Sheets

FOLDING SIDE-WALL CONTAINER AND AUTOMATED SYSTEM OF USE

CROSS-REFERENCE TO RELATED APPLICATIONS

This Application claims the benefit of U.S. Provisional Patent Application Ser. No. 61/634,008 that was filed on Feb. 22, 2012 entitled "Reusable Totes With Folding Side Wall" and U.S. Provisional Patent Application Ser. No. 61/634,010 that was filed on Feb. 22, 2012 entitled "Tote Automation Concepts".

TECHNICAL FIELD

This disclosure relates to containers utilized in transport of goods typically sold at retail stores, such as pharmacy chain stores, hardware stores, etc., and in particular relates to such a container having a folding side wall.

BACKGROUND ART

It has become common in the industry of distribution of retail consumer goods to minimize manual labor by using increasingly automated inventory re-supply from a central distribution center to specific retail outlets. For example, as consumers purchase specific retail goods, bar-code scanners and cash registers immediately transmit information of the purchase of those specific retail goods from the retail store to a distribution center that warehouses a wide variety of goods. At the distribution center, the retail store sales information is collected and transmitted to distribution apparatus that selects a re-supply of the specific goods purchased and places the re-supply goods in a shipping container to be shipped with other re-supply goods to the one particular retail store.

Such shipping containers have taken on a fairly common structure in recent years, wherein a hinged lid folds over a rectangular, distribution container, and wherein a base of the container is configured to nest within a closed top of a second container so that the containers are stackable. Such a container is shown in U.S. Pat. No. 5,452,847 that issued on Sep. 26, 1995. A more recent version that is commonly seen in large chain pharmacy stores, such as "RITE AID, Inc." is available under the model name "Distribution Container with Hinged Lid" from a company entitled "GLOBAL" through their website www.globalindustrial.com.

These containers simplify distribution by providing containers filled with goods that are appropriate for a particular aisle of the store, and the goods in the containers can be hand placed on shelves by store workers without any need for intermediate storage room wherein traditionally larger sized, palletized freight containers are stored and broken down for distribution from the store room into the aisles and on shelves.

While these containers have such benefits, they also have drawbacks related to automated loading of the containers at the distribution center. Frequently distribution centers utilize laborers to hand-select re-supply goods from wholesale pallets or other such containers and place them into the distribution containers. The laborer typically moves the distribution container along a roller conveyor while selecting goods from a row of wholesale supply containers or pallets aligned adjacent the roller conveyor.

Efforts have been made to automate this procedure of filling a retail distribution container utilizing an automated or robotic picker with a vision capability that is controlled by a computer system typically utilizing a manual operator only for correcting errors, or assuring correct selection and placement of the re-supply goods within the retail distribution containers. It is also common for such automated systems to have the wholesale supply container be a four-sided, open-top container, which may be identical to the retail distribution container.

In such circumstances the vision system of the automated picker can only see into the containers from their open tops, and the pickers must lift an entire weight of the goods out of the wholesale container, move the lifted goods across a distance, such as over a picker conveyor support, and then place the goods into the distribution container through the open top. This requires that the automated picker have substantial grabbing and weight lifting capacity and also have substantial vertical motion capability. When the distribution container arrives at an aisle within a retail store, the goods must also be lifted out of the container through the top and then placed on store shelves. The most prevalent distribution containers also utilize a hinge lid having two half portions that interlock, giving rise to a substantial number of pinched-finger injuries arising from the interlocking mechanism.

Accordingly, there is a need for a distribution container and system of use of the container that overcomes the deficiencies of known distribution container and systems thereof.

SUMMARY OF THE DISCLOSURE

The disclosure includes a folding side-wall container having a base with a front edge and an opposed back edge and having a first side edge and an opposed second side edge extending between and defining perimeter side edges of the base. A front wall is secured to and extends away from the front edge; a first side wall is secured to and extends away from the first side edge; a back wall is secured to and extends away from the back edge; and, a second side wall is secured to and extends away from the second side edge. The front wall, first side wall, back wall and second side wall are configured to be secured to each other to form an enclosure over the base. The front wall is pivotally secured to the front edge and is also releasably secured to the side walls so that the front wall may pivot away from the side walls to define an opening into the enclosure over the base between the side walls and to possibly also form a support surface adjacent the base, or to simply hang below the base, such as when the base is supported on a shelf and the front wall hangs below the shelf.

A top lid is dimensioned to enclose the container, and the top lid is pivotally secured to a top edge of one of the back wall, the first side wall and the second side wall. The top lid includes an engagement lip extending from at least a front edge of the top lid, wherein the engagement lip is configured to overlie and secure a top edge of the front wall from disengagement with the engagement lip whenever the top lid overlies the top edge of the front wall to close the container.

A user pivots open the top lid, disengaging the engagement lip from the top edge of the front wall, and then the user may fold down the front wall from engagement with the sidewalls. Opposed side edges of the front wall may include any type of fastening means for releasably securing the side edges to the side walls, such as magnets, compression fasteners, "Velcro" style hook and loop strip fasteners, metal or plastic snaps, etc. Similarly, the engagement lip of the top lid may include any fastening means appropriate for releasably securing the top lid to the front wall and side walls. For example, the engagement lip may be a flange that extends from the front perimeter in a direction toward the base and dimensioned to compress against the top edge of the front wall. Alternatively, the engagement lip may include traditional fasteners, such as compression snap fasteners, those fasteners mentioned above, or any fastener known in the art that can perform the function of releasably securing the top lid to the top edge of the front wall to prevent the front wall from folding open whenever the top lid overlies the top edge of the front wall.

By having the front wall fold open, removal of goods from and placement of goods into the container is greatly facilitated, especially in an automated filling system. In such an automated system, the wholesale goods container may also be a folding side-wall container of the present disclosure. This provides for the automated picker having dramatically enhanced vision of goods within both the wholesale and distribution containers. Additionally, as the distribution container and automated picker move along a conveyor that has a plurality of wholesale containers adjacent the container, the picker simply has to slide a package of goods from the wholesale container to the distribution container. Therefore, the picker does not have to have the capacity to pick up the full weight of a package of goods, lift, carry across the conveyor and place the goods into the distribution container. Instead, the picker can simply slide the package from the wholesale container to the distribution container.

In another embodiment of the disclosure, the folding side wall container may also include a corrugated, semi-rigid cardboard-type box nested within the container, wherein the corrugated box has a front wall and top lid removed to facilitate removal and placement of goods within the corrugated, semi-rigid box.

In a further embodiment, the system of automated transfer of goods from a wholesale container by a robotic picker to a distribution container may include positioning the distribution container so that the back edge of the base is lower than the front edge to facilitate sliding and efficient packing of the goods within the distribution container. In other words, the distribution container is tilted so that the back edge of the base is within a range between about five degrees and twenty degrees below a plane defined by a picker support conveyor, and the front edge is positioned above the back edge and adjacent the conveyor. In another embodiment, to further facilitate picking and placement by the automated or robotic picker, the wholesale container is also tilted so that its back edge of its base is likewise below the plane defined by the picker support conveyor and its front edge is above the back edge and adjacent the conveyor.

In a further embodiment, to again facilitate automated transfer from the wholesale container to the distribution container, the picker support conveyor may include a cross-roller support surface configured so that packages moving from the wholesale container to the distribution container move along rollers within the picker support conveyor to minimize friction during movement by the robotic picker.

In another embodiment referred to as a short-front-wall container embodiment, the front wall of the folding wall container may be a short front wall extending from the front edge of the base upwards away from the base between about thirty percent and about seventy percent of a distance between the base and top edges of the side wall. The short wall also includes extension flaps on opposed side edges configured to fold around and be secured to exterior surfaces of the side walls. The top lid also includes a front extension configured to extend between the front edges of the side walls and to overlap and be secured to the short front wall, and side the front extension also includes extension flaps on opposed side edges of the top lid that are configured to fold around and be secured to exterior surfaces of the side walls.

The short-front-wall container embodiment may be formed of traditional corrugated, semi-rigid cardboard and may be utilized by integrating it with the folding-wall container made of rigid plastic. The short-front-wall container may be inserted into the folding-wall as a distribution container. As the rigid folding-wall container moves along the picker conveyor, the short-front-wall container is easily filled with predetermined goods. When filled the short front wall is raised and its extension flaps are secured, such as by gluing to the exterior surfaces of the side walls and the top lid is closed over the top and its front extension is dimensioned to overlap the short front wall and be secured to it as the side extension of the top lid are secured to exterior surfaces of the side walls. The closed short-front-wall container may then be removed from the rigid plastic folding wall container and distributed within a pallet or otherwise as traditional corrugated cardboard containers are distributed. By utilizing the corrugated cardboard or other semi-rigid short-front-wall container, the modest structural integrity of the container is reinforced by the rigid plastic folding side-wall container within which it is nested.

The automated system of use of the folding side-wall container of the present disclosure also includes a method of use of the system. The method includes positioning of the folding side-wall container adjacent an automated picker; folding the front wall open so that the opening into the container defined by the open front wall is adjacent the picker; positioning a supply of goods adjacent an opposed side of the automated picker; picking goods by the automated picker from the supply of goods; sliding the picked goods with the automated picker through the opening defined by the open front wall into the folding side-wall container; then closing the front wall of the container; and, then securing the front wall in a closed position by placing the top lid of the container so that it overlies the top edge of the front wall and the engagement lip of the top lid secures the front wall to the top lid. The method may also include utilizing a folding side-wall container to contain the supply of goods; tilting the side-wall containers as described above; integrating the short-front-wall semi-rigid container within the folding side-wall container receiving the goods, and then sealing and removing the semi-rigid container.

Accordingly, it is a general purpose of the present disclosure to provide a folding side-wall container and automated system of use that overcomes deficiencies of the prior art.

These and other purposes and advantages of the present folding side-wall container and automated system of use will become more readily apparent when the following description is read in con junction with the accompanying drawings.

PREFERRED EMBODIMENTS OF THE DISCLOSURE

Figure 1:
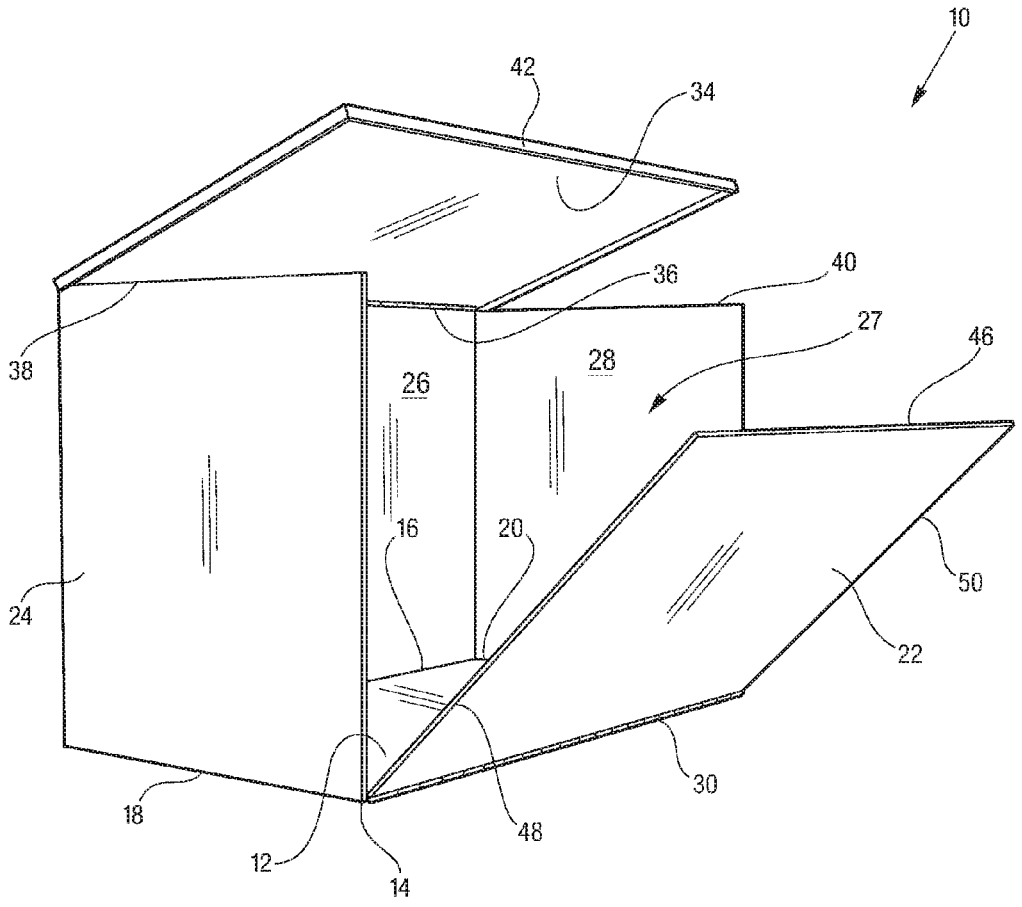
FIG. 1 is a side perspective view of a folding side-wall container construction in accordance with the present disclosure, showing a front wall partially opened and a top lid partially opened.
Figure 2:
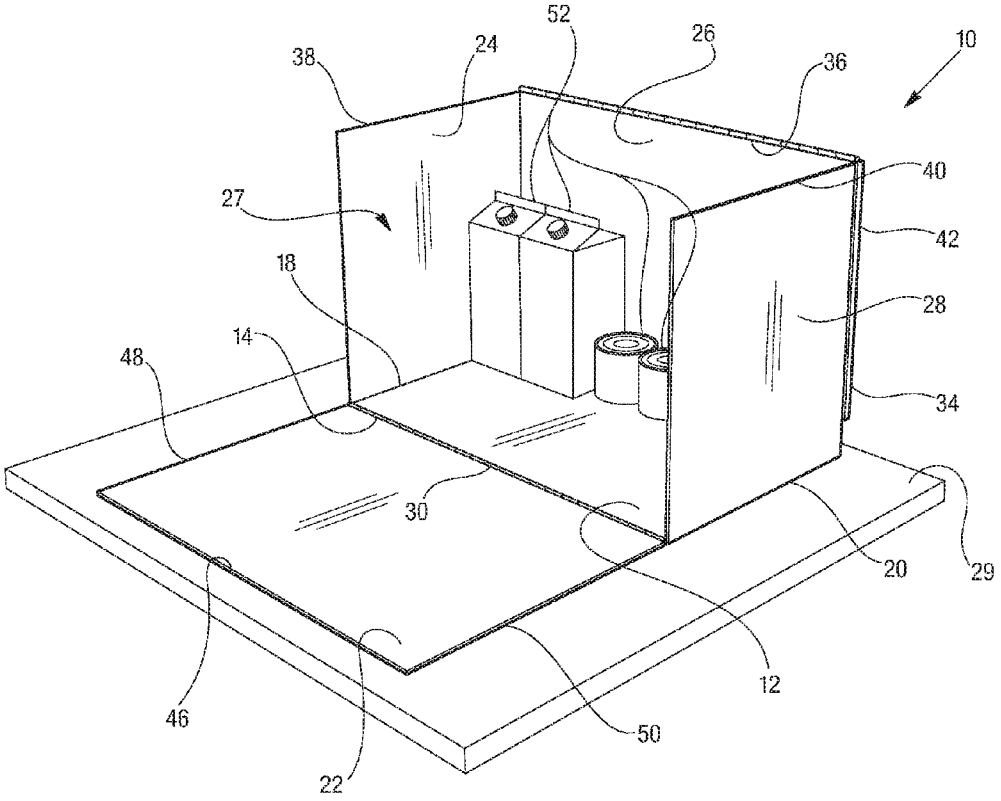
FIG. 2 is a side perspective view of the folding side-wall container of FIG. 1 and showing the front wall completely opened, the top lid completely opened, and showing several goods within the container.
Figure 3:
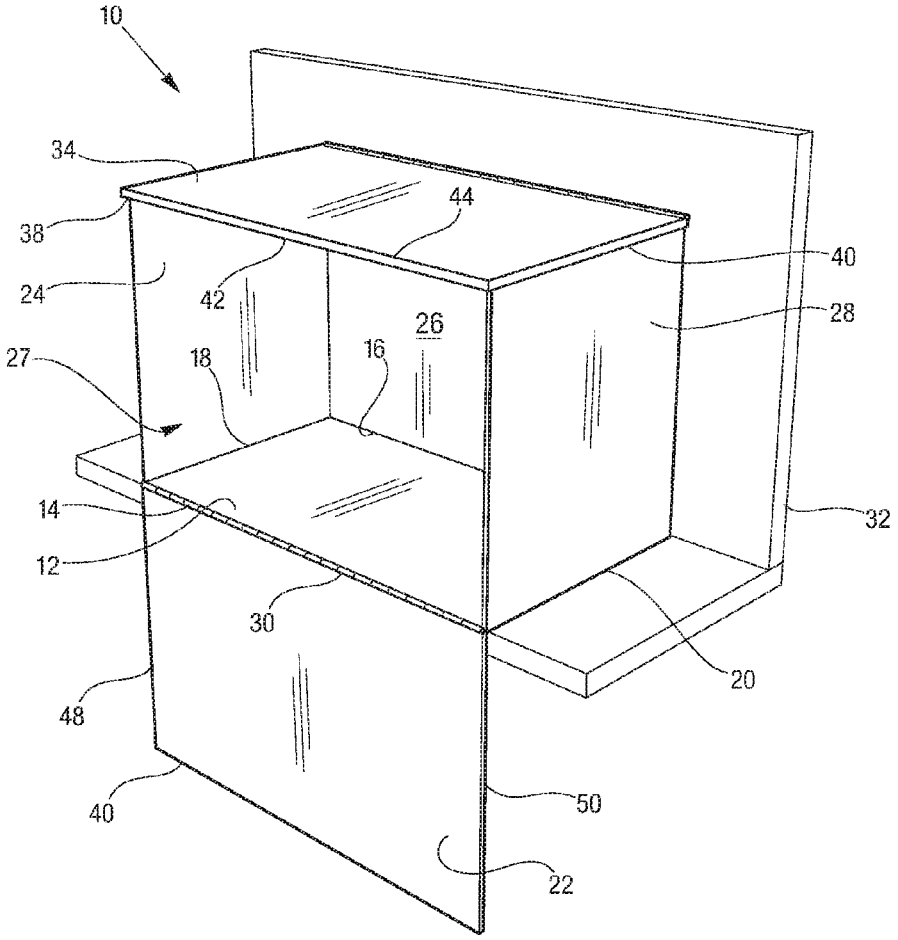
FIG. 3 is a side perspective view of the folding side-wall container of FIG. 1, showing the container supported on a shelf with the front wall hanging below the shelf, and the top lid in the closed position.

Referring to the drawings in detail, a simplified schematic drawing of a folding side-wall container of the present disclosure is shown best in FIGS. 1-3, and is generally designated by the reference numeral 10. The folding side-wall container 10 includes a base 12 with a front edge 14 and an opposed back edge 16 and having a first side edge 18 and an opposed second side edge 20 extending between and defining perimeter side edges 18, 20 of the base 12. A front wall 22 is secured to and extends away from the front edge 14 of the base 12; a first side wall 24 is secured to and extends away from the first side 18 edge of the base 12; a back wall 26 is secured to and extends away from the back edge of the base 12; and, a second side wall 28 is secured to and extends away from the second side edge 20 of the base 12.

As described above, the front wall 22, first side wall 24, back wall 26 and second side wall 28 are configured to be secured to each other to define an enclosure 27 over the base 12. The front wall 22 is pivotally secured to the front edge 14 of the base 12 by a hinge 30 or other pivoting connectors known in the art. The front wall 22 is also releasably secured to the side walls 24, 28 so that the front wall 22 may pivot away from the side walls 24, 28 to define an opening into the enclosure 27 over the base 12 between the side walls 24, 28 and to possibly also form a support surface 22 adjacent the base 12 and upon a planar support table 29, as best shown in FIG. 2. The front wall 22 may also simply hang below the base 12, such as when the base is supported on a shelf 32 and the front wall 22 hangs below the shelf 32 and a top lid 34 is closed over the side walls 24, 28, as shown in FIG. 3.

The top lid 34 is dimensioned to enclose the container 10, and the top lid 34 is pivotally secured to a back wall 26 top edge 36, a first side wall 24 top edge 38, or a second side wall 28 top edge 40. The top lid 34 includes an engagement lip 42 extending from at least a front edge 44 of the top lid 34. The engagement lip 42 is configured to overlie and secure a top edge 4 of the front wall 22 from disengagement with the engagement lip 42 whenever the top lid 22 overlies the top edge 46 of the front wall 22 to close the container 10.

A user (not shown) pivots open the top lid 34, disengaging the engagement lip 42 from the top edge 46 of the front wall 22, and then the user may fold down the front wall 22 from engagement with the first and second sidewalls 24, 28. A front wall 22 first side edge 48 and an opposed front wall 22 second side edge 50 may include any type of fastening means for releasably securing the front wall 22 side edges 48, 50 to the first and second side walls 24, 28, such as magnets (not shown), compression snap fasteners (not shown), "Velcro" style hook and loop strip fasteners (not shown), metal or plastic snaps (not shown), etc. Similarly, the engagement lip 42 of the top lid 34 may include any fastening means appropriate for releasably securing the top lid 34 to the front wall 22 and side walls 24, 28. For example, the engagement lip 42 may be a flange 42 that extends from the top lid 34 front edge 44 in a direction toward the base 12 and dimensioned to compress against the top edge 46 of the front wall 22. Alternatively, the engagement lip 42 may include traditional fasteners (not shown), such as compression snap fasteners (not shown), those fasteners mentioned above (not shown), or any fastener known in the art that can perform the function of releasably securing the top lid 34 to the top edge 46 of the front wall 22 to prevent the front wall 22 from folding open whenever the top lid 34 overlies the top edge 46 of the front wall 22. By having the front wall 22 fold open, removal of goods 52 (shown in FIG. 2) from and placement of goods 52 into the container 10 is greatly facilitated, especially in an automated container filling system described below.

Figure 4:
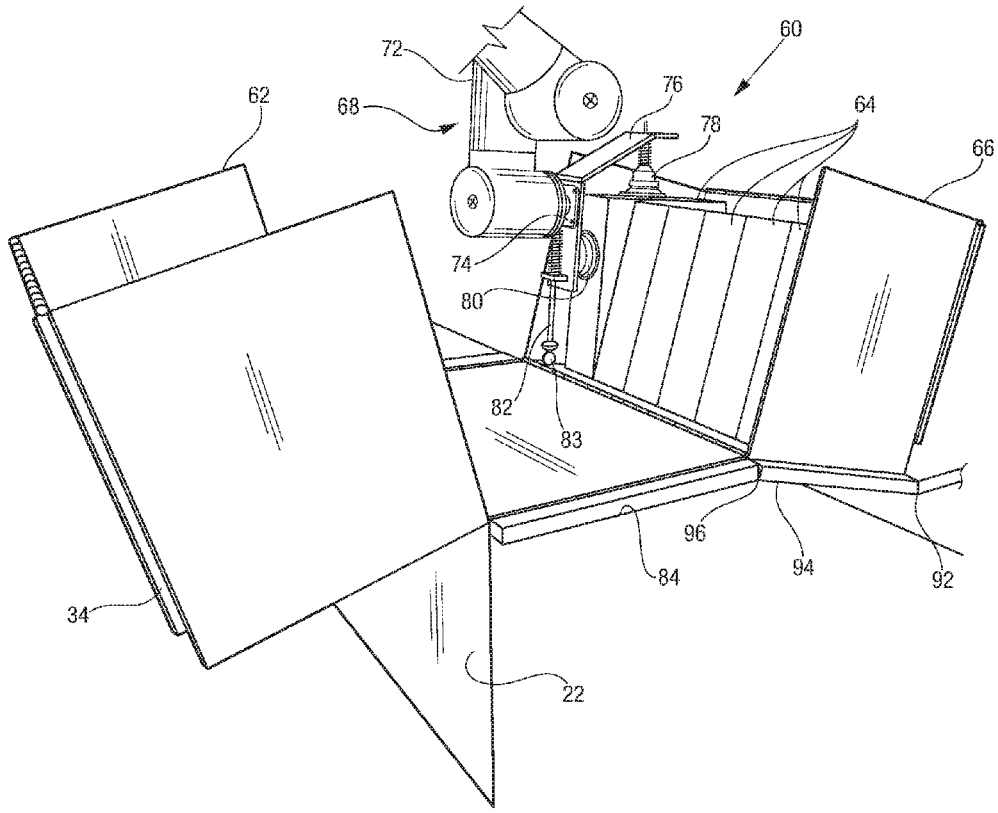
FIG. 4 is a front perspective, simplified, fragmentary view of an automated picker commencing picking of a package of goods from a folding side-wall container containing a supply of goods.
Figure 5:
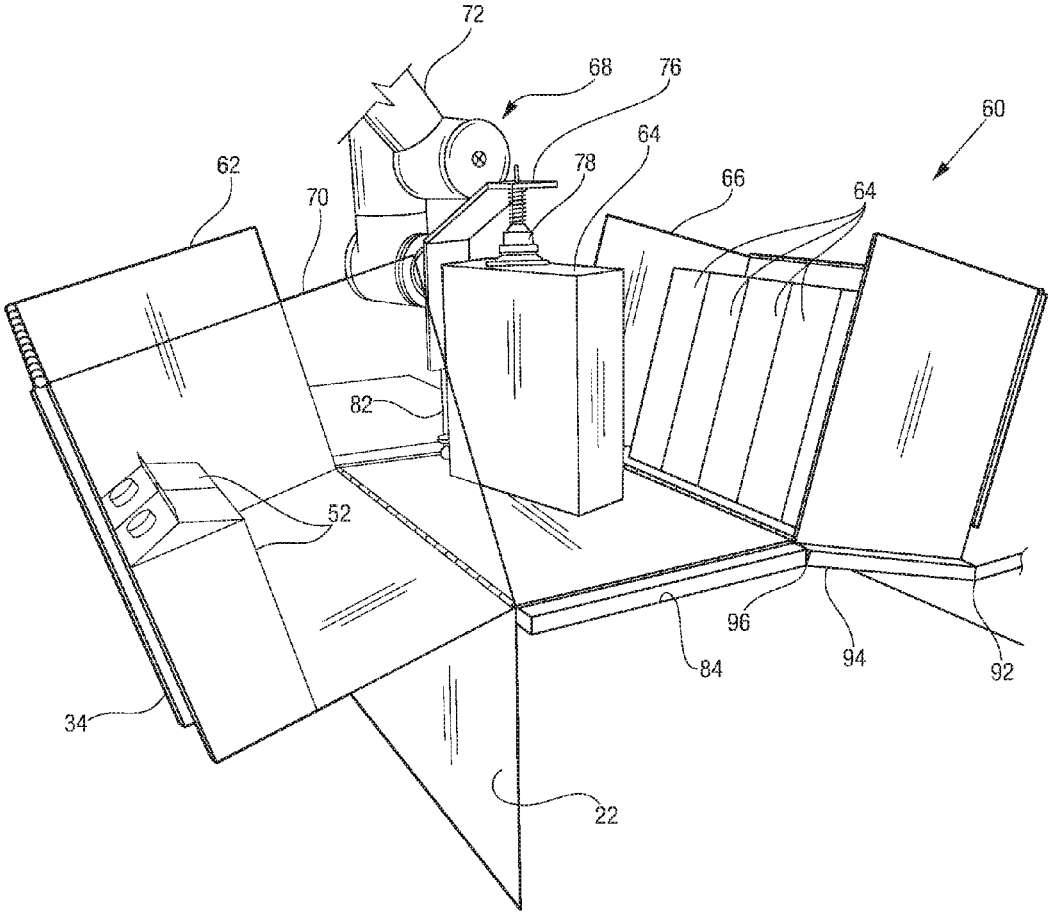
FIG. 5 is a front perspective, simplified, fragmentary view of the FIG. 4 picker showing the package of goods being moved by sliding toward a distribution folding side-wall container.
Figure 6:
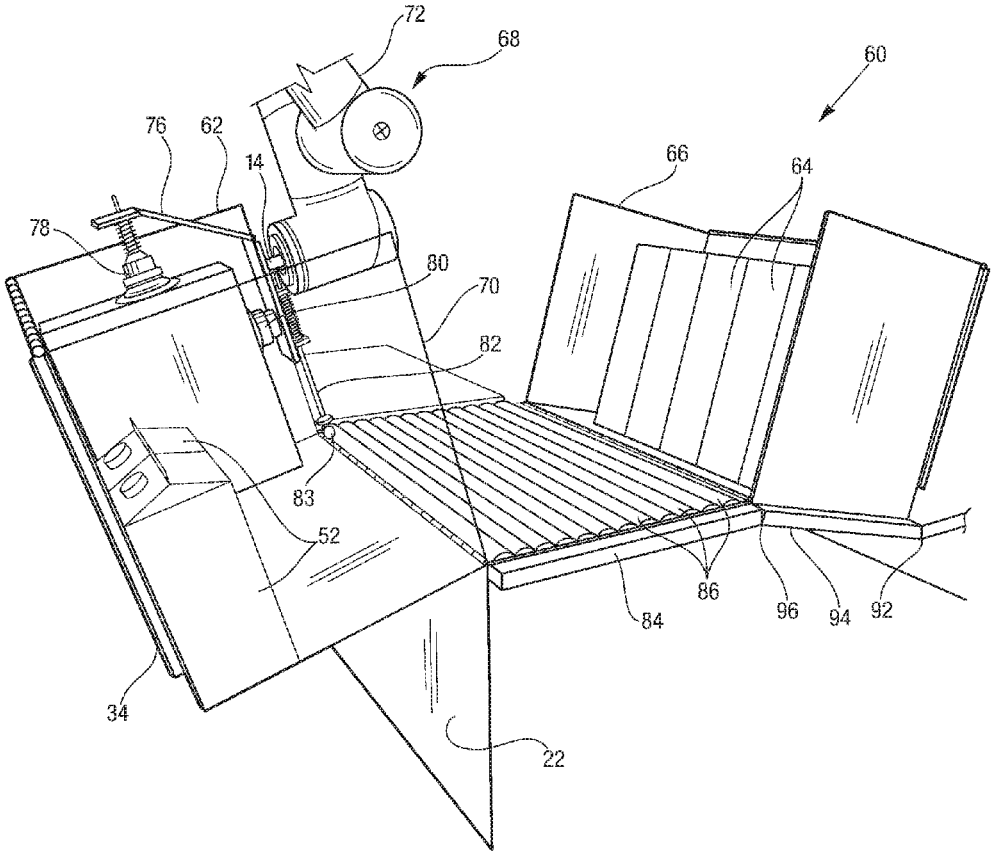
FIG. 6 is a front perspective, simplified, fragmentary view of the FIG. 5 picker showing the package of goods being positioned with the distribution folding side-wall container.

FIGS. 4-6 show sequential views of a system 60 for automated transfer of goods 64 from a wholesale goods container 66 to a distribution container 62. The system 60 includes at least a first folding side-wall container 62 of the present disclosure for receiving goods 64. For purposes of clarity, the first folding side-wall container 62 that receives goods 64 in the automated system 60 will be referred to herein as a distribution container 62. Additionally, a second folding side-wall container 66 stores the goods 64 for transfer by an automated picker 68 to the distribution container 62, and the second folding side-wall container 66 will be referred to herein as a wholesale goods container 66. The wholesale goods container 66 may or may not be a folding side-wall container 10 of the present disclosure.

By having both the distribution container 62 and the wholesale goods container 66 be folding side-wall containers 62, 66, the automated picker 68 will have enhanced vision capability of the goods 64 within both the wholesale and distribution containers 66, 62. FIGS. 4-6 show a simplified schematic drawing of an automated picker 68. The automated picker 68 includes a suspension support arm 72, a vision element 74, a grab bar 76 supporting a first grab device 78 and a second grab device 80, and a support strut 82 having support wheel 83. As shown in FIG. 4-6, the vision element 84 identifies a particular package of goods 64 and informs a controller (not shown) to position the first and second grab devices 78, 80 on the desired package of goods 64 (as shown in FIG. 4). The picker 68 then moves, such as by sliding, the package of goods 64 out of the wholesale container 66 across a picker support conveyor 84 (as shown in FIG. 5) and then into the distribution container 62 (as shown in FIG. 6). While FIGS. 4-6 show a simplified automated picker 68, it is to be understood however, that the automated system 60 of the present disclosure includes any automated picker means for picking a package of goods 64 from a supply location 66 and transferring it to a re-supply location, such as the distribution container 62. Additionally, for purposes of illustration only, FIGS. 5 and 6 show a transparent first side wall 70 having exemplary different goods 52 stored in the distribution container 62.

The automated system 60 may also include a standard conveyor for selectively moving the distribution container 62 along the picker support conveyor 84. For example, the picker support conveyor 84 may include attachment means for securing the distribution container 62 adjacent the conveyor 84 and for selectively moving the distribution container 62 to and from a position across the conveyor 84 from the wholesale goods container 66 and on to a position adjacent another wholesale goods container (not shown) that contains other goods (not shown).

Because the automated picker 68 only has to slide the goods 64 from the wholesale container 66 to the distribution container 62, the automated picker 68 does not have to have the capacity to pick up the full weight of a package of goods 64, lift, carry across the picker support conveyor 84 and place the goods into the distribution container 62. Instead, the automated picker 68 can simply slide the package of goods 64 from the wholesale container 66 to the distribution container 62.

In a further embodiment of the present automated system 60, to again facilitate automated transfer from the wholesale container 66 to the distribution container 62, the picker support conveyor 84 may include one or more cross-rollers 86 (shown only in FIG. 6), wherein the cross-rollers 86 are aligned to facilitate sliding of the goods 64 from the wholesale goods container 66 to the distribution container 62, such as being aligned transverse to a direction of movement of the distribution container 62 along the picker support conveyor 84. The cross-rollers 86 may also be cross-roller means for minimizing friction between the goods 64 and the picker support conveyor 84, including for example, raised ball bearings (not shown), low-friction surface materials etc.

Figure 9:
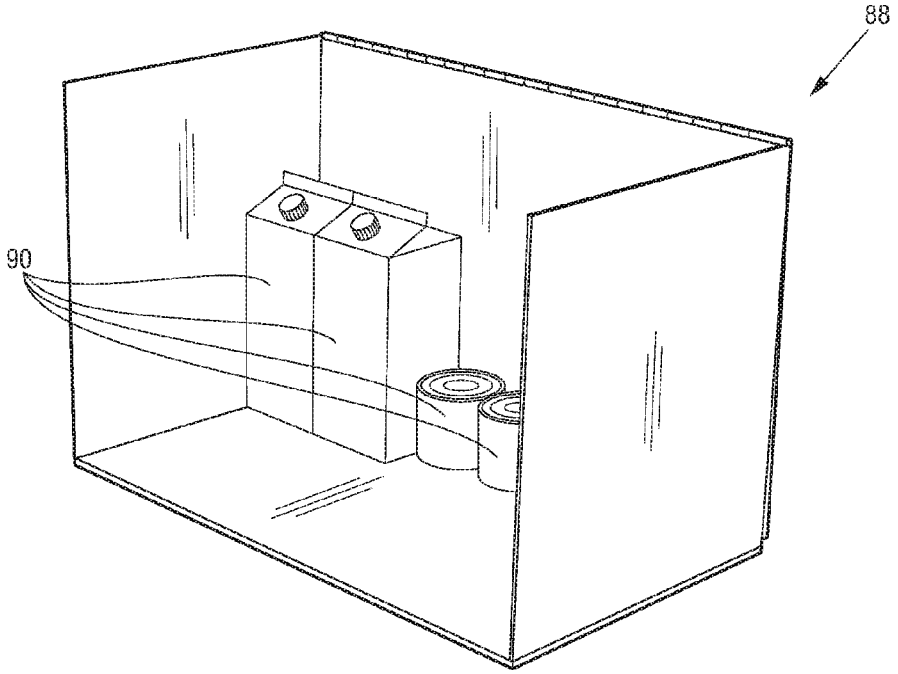
FIG. 9 is a side perspective view of a semi-rigid container having a front wall and a top lid removed and containing goods.
Figure 10:
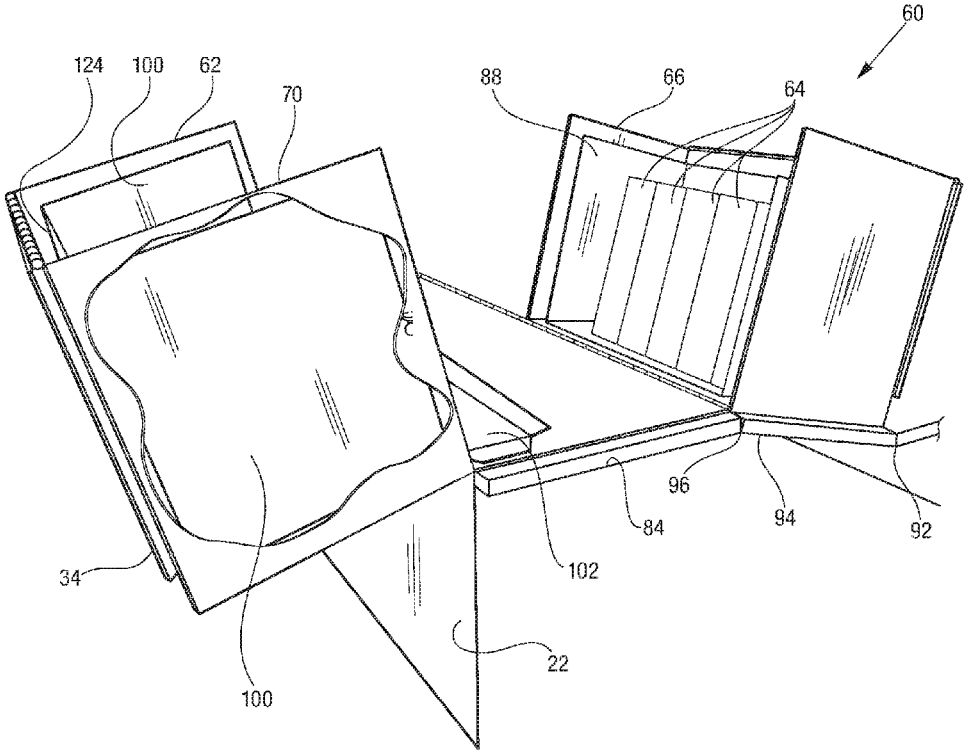
FIG. 10 is a front perspective, simplified, fragmentary view of a support conveyor showing a supply of goods within the FIG. 9 semi-rigid container that is secured within a folding side-wall wholesale goods container adjacent the support conveyor, and FIG. 10 also showing the FIG. 7 short-front-wall semi-rigid container secured within a folding side-wall distribution container adjacent the support conveyor.

In another embodiment of the present system 60, at least one of the first or second folding side wall containers 62, 66 may also include a corrugated, semi-rigid cardboard-type box 88 (shown in FIG. 9) nested within the container 62, 66. As shown in FIG. 9, the semi-rigid box 58 has a front wall (not shown) and top lid (not shown) removed to facilitate removal and placement of goods 90 within the corrugated, semi-rigid box 88. Otherwise, the box 88 is similar in overall form to the folding side-wall container 10 of the present invention. By removing the front wall and top lid of the semi-rigid box 88 (such as a traditional cardboard box housing breakfast cereal packages of goods 90) the box 88 may be nested within, for example the second folding side-wall container 66 or wholesale goods container 66, prior to positioning the wholesale goods container 66 adjacent the picker support conveyor 84. This aspect of the system 60 enables transfer of traditional, semi-rigid cardboard box types of containers directly into the wholesale goods container 66 without having to manually extricate the individual packages of goods 90 to place them into the wholesale goods container 66. While FIG. 9 shows different sized packages of goods 90, it is to be understood that the most common use of this aspect of the system is that the semi-rigid container 88 would contain same sized packages of goods such as those shown at reference numeral 64 in FIG. 4.

In a further embodiment, the system 60 of automated transfer of goods 64 from a wholesale goods container 66 by an automated, robotic picker 68 to a distribution container 62 may include positioning a distribution container 62, 10 so that the back edge 16 of the base 12 is lower than the front edge 14 to facilitate sliding and efficient packing of the goods 64 within the distribution container 62, 10. The distribution container 62, 10 is tilted so that the back edge 16 of the base 12 is within a range between about five degrees and twenty degrees below a plane defined by the picker support conveyor 84, and the front edge 14 of the base 12 is positioned above the back edge 16 and adjacent the picker support conveyor 34. In another embodiment of the system 60, to further facilitate picking and placement by the automated nicker 68, the wholesale container 66 is also tilted so that its back edge 92 of its base 94 is likewise below the plane defined by the picker support conveyor 84 and its front edge 96 is above the back edge 92 and adjacent the conveyor 84.

Figure 7:
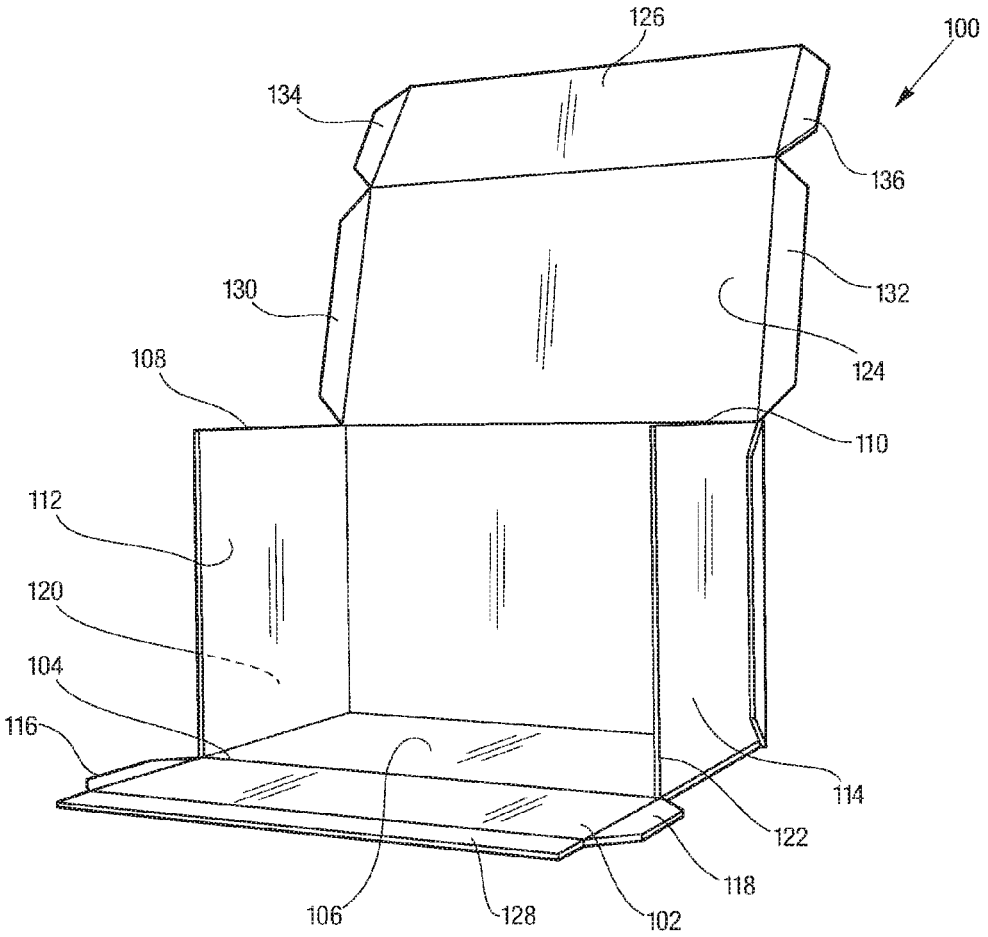
FIG. 7 is a front perspective view of a short-front-wall semi-rigid container embodiment of the present invention showing a short-front-wall open and showing a top lid open.
Figure 8:
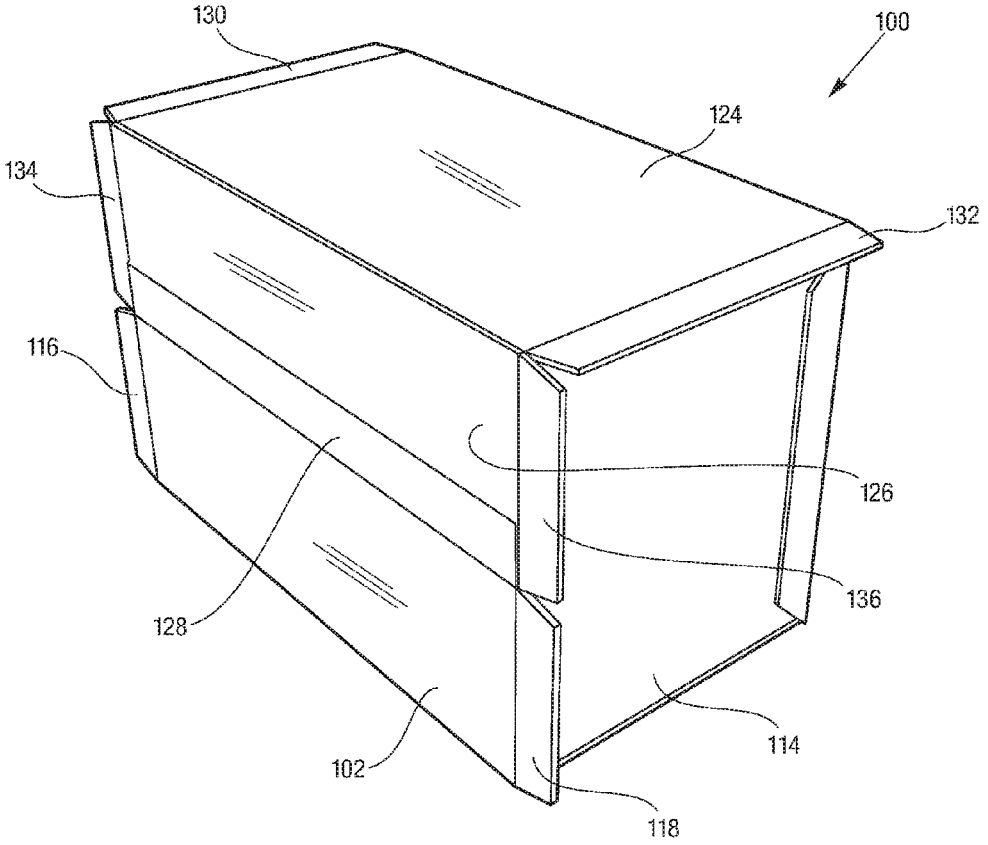
FIG. 8 is a front perspective view of the FIG. 7 short-front-wall semi-rigid container embodiment showing the short-front-wall closed and the top lid closed.

FIGS. 7 and 8 show another embodiment of the present disclosure, referred to as a short-front-wall container 100 embodiment. In this embodiment, a front wall 102 of the folding wall container 100 may be a short front wall 102 extending from the front edge 104 of the base 106 upwards away from the base 106 between about thirty percent and about seventy percent of a distance between the base 106 and top edges 108, 110 of opposed first 112 and second 114 side walls. The short front wall 102 also includes a first extension flap 116 and a second extension flap 118 on opposed side edges of the front wall 102. The first and second extension flaps 116, 118 are configured to fold around and be secured to exterior surfaces 120, 122 of the side walls 112, 114. A top lid 124 also includes a front extension 126 configured to extend between the side walls 112, 114 and to overlap and be secured to the short front wall 102, and any securing extension 128 extending out of the short front wall 102. The top lid 124 may also include first and second side top lid side flaps 130, 132 on opposed side edges of the top lid that are configured to fold around and be secured to the exterior surfaces 120, 122 of the side walls 112, 114. The top lid 124 may also include additional top lid first 134 and second 136 front extension flaps 134, 136 extending out of opposed sides of the front extension 126.

The short-front-wall container embodiment 100 may be formed of traditional corrugated, semi-rigid cardboard and may be utilized by integrating the container 100 within the folding side-wall container 10 made of rigid plastic or similar rigid materials. The short-front-wall container 100 may be inserted into the folding side-wall as a distribution container 62. As the rigid folding-wall container 62 moves along the picker support conveyor 84, the short-front-wall container 100 is easily filled with predetermined goods 64. When filled the short front wall container 100 is raised and the extension flaps 116, 118 are secured, such as by gluing to the exterior surfaces 120, 122 of the side walls 112, 114. The top lid 124 is then closed over the top and its front extension 126 is dimensioned to overlap the short front wall 102 and its securing extension 128 and to be secured to it. The side flaps 130, 132 and extension flaps 134, 136 of the top lid are secured to exterior surfaces 120, 122 of the side walls 112, 114. The closed short-front-wall container 100 may then be removed from the rigid plastic folding side-wall distribution container 62 and distributed within a pallet of such containers 100 (not shown) or otherwise as traditional, semi-rigid corrugated cardboard containers are distributed. FIG. 8 shows the short-front-wall container 100 closed and with the side flaps 116, 118, 130, 132, 134, 136, extended in preparation for gluing. By utilizing the corrugated cardboard or other semi-rigid short-front-wall container, the modest structural integrity of the container is reinforced by the rigid plastic folding side-wall distribution container 62 within which it is nested while also adding the efficiency of slide loading through the open short front wall 102.

The automated system 60 of use of the folding side-wall containers 10, 60, 62 of the present disclosure also includes a method of use of the system 60. The method includes positioning of the folding side-wall container 10, 62 adjacent an automated picker 68; folding the front wall 22 open so that the opening into the container 10, 62 defined by the open front wall 22 is adjacent the picker 68; positioning a supply of goods 64 adjacent an opposed side of the automated picker 68; picking goods 64 by the automated picker from the supply of goods 64; sliding the picked goods 64 with the automated picker 68 through the opening defined by the open front wall 22 into the folding side-wall container 10, 62; then, closing the front wall 22 of the container; and, then securing the front wall in a closed position by placing the top lid 34 of the container 10, 62 so that it overlies the top edge 46 of the front wall 22 and the engagement lip 42 of the top lid 34 secures the front wall 22 to the top lid 34. The method may also include utilizing a second folding side-wall container 66 to contain the supply of goods 64. Additionally, the method may also include all or one of: tilting the distribution side-wall container 62; tilting the wholesale goods container 66; integrating the short-front-wall semi-rigid container 100 within the folding side-wall distribution container 62 receiving the goods, and then sealing and removing the semi-rigid container 100. Also, the method may include removing a front wall and top lid from a semi-rigid container 88 containing a supply of goods 90; and, positioning the opened semi-rigid container in the wholesale goods container 66.

The folding side-wall containers 10, 60, 66 of the present disclosure minimize costly labor expenses in distribution of consumer goods 52, 64, 90 even if they are used by manual loading and transfer of the goods. If the containers 10, 62, 66, however, are utilized in the system 60 for automated transfer of goods 64 from a wholesale goods container 66 to a distribution container 62, enormous advantages in decreasing distribution and handling costs are achieved.

For purposes herein, the word "about" is to mean plus or minus ten percent.

While the present disclosure has been presented above with respect to the described and illustrated embodiments of folding side-wall container 10 and automated system 60 of use, it is to be understood that the disclosure is not to be limited to those illustrations and described embodiments. Accordingly, reference should be made primarily to the following claims rather than the forgoing description to determine the scope of the disclosure.

What is claimed is:

1. A system for automated transfer of goods from a supply of goods to a distribution container, the system comprising:

a. at least a first folding side-wall distribution container for receiving goods;

b. a supply of goods secured within a wholesale goods folding side-wall container, wherein each package of goods of the supply of goods is dimensioned for storage within the folding side-wall distribution container;

c. wherein the folding side-wall distribution container and the wholesale goods folding side-wall container each include;

i. a base having a front edge and an opposed back edge and having a first side edge and an opposed second side edge extending between and defining perimeter side edges of the base;

ii. a front wall secured to and extending away from the front edge, a first side wall secured to and extending away from the first side edge, a back wall secured to and extending away from the back edge and a second side wall secured to and extending away from the second side edge, the front wall, first side wall, back wall and second side wall being configured to be secured to each other to form an enclosure over the base;

iii. the front wall being pivotally secured to the front edge and releasably secured to the side walls so that the front wall may pivot away from the side walls to define an opening between the side walls into the enclosure over the base;

d. an automated picker secured between the opening defined by the pivoted-away front wall of the wholesale goods folding side-wall container and the opening defined by the pivoted-away front wall of the folding side-wall distribution container, the automated picker being configured for selecting and removing a package of goods from the wholesale goods folding side-wall container and sliding the selected package of goods through the opening defined by the pivoted-away front wall of the wholesale goods folding side-wall container and through the opening defined by the pivoted-away front wall of the folding side-wall distribution container into an enclosure of the folding side-wall distribution container.

2. The system of claim 1, further comprising a picker support conveyor for supporting the automated picker, and the distribution folding side-wall container being tilted so that a back edge of a base of the container is positioned within a range of between about five degrees and about twenty degrees below a plane defined by the picker support conveyor, and a front edge of the base of the distribution container is positioned above the back edge and adjacent the picker support conveyor.

3. The system of claim 2, further comprising the wholesale goods folding side-wall container being tilted so that a back edge of a base of the container is positioned within a range of between about five degrees and about twenty degrees below a plane defined by the picker support conveyor, and a front edge of the base of the distribution container is positioned above the back edge and adjacent the picker support conveyor.

4. The system of claim 1, further comprising a picker support conveyor for supporting the automated picker, and wherein the picker support conveyor includes at least one cross-roller, the cross-roller being aligned transverse to a direction of movement of the distribution container to facilitate sliding of the goods from the supply of goods into the distribution container.

5. The system of claim 1, further comprising a semi-rigid box positioned to nest within the wholesale goods folding side-wall container, wherein the semi-rigid box has a front wall removed and has a top lid removed to facilitate removal of goods from within the semi-rigid box.

6. The system of claim 1, further comprising a short-front-wall container positioned to nest within the distribution folding side-wall distribution container, the short-front-wall container including:

a. a short front wall extending from the front edge of the base away from the base between about thirty percent and about seventy percent of a distance between the base and top edges of the opposed first and second side walls;

b. the short front wall also including a first extension flap and a second extension flap on opposed side edges of the short front wall, the first and second extension flaps being configured to fold around and be secured to exterior surfaces of the opposed side walls; and, c. the top lid including a front extension configured to extend between the side walls and to overlap and be secured to the short front wall.

* * * * *